US007795539B2

(12) United States Patent
Thuot et al.

(10) Patent No.: US 7,795,539 B2
(45) Date of Patent: Sep. 14, 2010

(54) CRUSH RESISTANT CONDUCTOR INSULATION

(75) Inventors: Gary Thuot, Hockessin, DE (US); Robert Thomas Young, Newark, DE (US); John L. Netta, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/429,280

(22) Filed: Apr. 24, 2009

(65) Prior Publication Data

US 2009/0229852 A1 Sep. 17, 2009

Related U.S. Application Data

(63) Continuation-in-part of application No. 12/403,671, filed on Mar. 13, 2009.

(60) Provisional application No. 61/037,055, filed on Mar. 17, 2008, provisional application No. 61/037,192, filed on Mar. 17, 2008, provisional application No. 61/123,814, filed on Apr. 10, 2008.

(51) Int. Cl.
*H01B 7/00* (2006.01)

(52) U.S. Cl. ..... 174/110 R; 174/112; 174/113 R

(58) Field of Classification Search ..... 174/110 R, 174/113 R, 113 AS, 120 R, 120 SR, 120 SO, 174/112

See application file for complete search history.

(56) References Cited

U.S. PATENT DOCUMENTS 2,583,025 A * 1/1952 Swift et al. ..... 174/117 R
2,583,026 A * 1/1952 Swift ..... 174/117 R
3,085,083 A 4/1963 Schreyer
3,999,003 A * 12/1976 Chevrolet et al. ..... 174/23 R
4,029,868 A 6/1977 Carlson
4,742,122 A 5/1988 Buckmaster
4,743,658 A 5/1988 Imbalzano et al.
5,210,377 A * 5/1993 Kennedy et al. ..... 174/107
5,677,404 A 10/1997 Blair (Continued)

FOREIGN PATENT DOCUMENTS

EP 0387796 A1 9/1990

(Continued)

OTHER PUBLICATIONS

International Search Report, PCT/US2009/037213, Jun. 30, 2009.

*Primary Examiner*—William H Mayo, III

(57) ABSTRACT

A process of twinning a pair of polymer-insulated conductors to form a twisted pair, where the polymer-insulated conductors are formed by extruding a uniformly thick coating of polymer onto the conductors. More than one twisted pair is encased in a polymer jacket forming a cable. The twisted pair obtains a desirable average impedance performance using a reduced amount by weight of polymer forming said polymer-insulated conductors by: (i) extruding to form longitudinally running peaks and valleys in the exterior surface of each of the polymer-insulated conductors of the pair of polymer-insulated conductors and (ii) twinning resultant polymer-insulated conductors to nest at least one of the peaks in the exterior surface of one of the polymer-insulated conductors in at least one of said valleys in the exterior surface of the other of the polymer-insulated conductors of the pair of polymer-insulated conductors.

14 Claims, 5 Drawing Sheets

U.S. PATENT DOCUMENTS

| | | | | |
|---|---|---|---|---|
| 5,990,419 | A * | 11/1999 | Bogese, II | 174/120 R |
| 6,239,377 | B1 | 5/2001 | Nishikawa | |
| 6,541,588 | B1 | 4/2003 | Kaulbach et al. | |
| 6,815,617 | B1 * | 11/2004 | Gebs et al. | 174/113 AS |
| 7,122,609 | B2 | 10/2006 | Earnest, Jr. et al. | |
| 7,135,641 | B2 * | 11/2006 | Clark | 174/110 R |
| 7,205,479 | B2 * | 4/2007 | Caveney | 174/110 R |
| 7,462,782 | B2 * | 12/2008 | Clark | 174/110 R |
| 7,560,646 | B2 * | 7/2009 | Heffner | 174/110 R |
| 2006/0118322 | A1 * | 6/2006 | Wiekhorst et al. | 174/110 R |
| 2008/0296042 | A1 | 12/2008 | Heffner | |

FOREIGN PATENT DOCUMENTS

| | | | |
|---|---|---|---|
| EP | 1783787 | A1 | 5/2007 |

* cited by examiner

CRUSH RESISTANT CONDUCTOR INSULATION

FIELD OF THE INVENTION

The present invention relates to a crush resistant conductor insulation. More particularly, the present invention relates to a crush resistant polymer insulated conductor twinning process or cable where the polymer insulation is foamed or unfoamed, has peaks and valleys, and maintains the electrical and mechanical properties of a typical cylindrical polymer insulated conductor.

BACKGROUND OF THE INVENTION

Twisted pair communications cable is used for high frequency signal transmission, typically in plenum areas of buildings. The cable is composed of typically multiple twisted pairs of polymer-insulated conductors, covered by a polymer jacket. In twisted pair data cables, the individual insulated conductors are typically twisted into pairs, and four pairs are cabled together and jacketed to make the cable. Each pair is twisted at a different lay (conventionally measured in inches/turn) to reduce electrical coupling between adjacent twisted pairs (i.e. crosstalk). The twisting together compresses (i.e. crushes) the polymer insulation. The shorter the lay, the tighter the twist and the greater the crush or compression of the polymer insulation (whether foamed or unfoamed). The twisted pairs are typically designed to have 100 ohms impedance. The center to center spacing of the conductors within the pair is a key factor affecting impedance. Therefore, because increased compression brings the conductors closer, additional insulation thickness is needed to maintain the desired impedance as the length of twist becomes shorter. The problem with increasing the amount of polymer insulation used is that there is an increase in cable weight and cable size.

It is thus desirable to have a polymer insulation that maintains the desired impedance and other electrical and mechanical properties without increasing the weight of the insulation material. The following disclosure may be relevant to various aspects of the present invention and may be briefly summarized as follows: U.S. Pat. No. 5,990,419 to Bogese, II discloses a primary conductor of wire (solid or strands) that are enclosed by a coating of solid insulation with radially outward extending ribs. The insulated ribs of a first insulated conductor are located adjacent to a second insulated conductor in which the outermost end of the first and second insulated conductor ribs abut. The abutting ribs of the first and second insulated conductors define air spaces which are between the ribs and increase the distance between conductors from each other, thereby reducing the capacitance of the cable assembly.

SUMMARY OF THE INVENTION

Briefly stated, and in accordance with one aspect of the present invention, there is provided a process of twinning a pair of polymer-insulated conductors to form a twisted pair, the twist in said twisted pair being in one direction, each of said polymer-insulated conductors being formed by extruding a uniform thickness of said polymer onto said conductors, wherein said polymer-insulated conductors have a cylindrical exterior surface, the improvement comprising:

improving impedance efficiency for said twisted pair as compared to polymer insulation of said uniform thickness of the same weight of said polymer by:

(i) carrying out said extruding to form longitudinally running peaks and valleys in the exterior surface of each of said polymer-insulated conductors of said twisted pair of polymer-insulated conductors;

(ii) backtwisting said pair of polymer-insulated conductors in the same direction prior to said twinning, said same direction being opposite to said one direction, (iii) twinning said pair of polymer-insulated conductors in said one direction, said backtwisting being effective in cooperation with said twinning to cause at least one of said peaks in said exterior surface of one of said polymer-insulated conductors to nest in at least one of said valleys in said exterior surface of the other of said polymer-insulated conductors of said pair of polymer-insulated conductors. Backtwisting of each of the polymer-insulated conductors, is carried out by gripping each of the polymer-insulated wires and rotating the polymer insulation and encased wire either in the clockwise or counterclockwise direction, depending on the direction of lay of the pair of insulated wires in the twinning step. If the lay (twinning) is left hand, then the backtwist for each of the insulated conductors is right hand. The backtwist causes the extruded peaks and valleys to become helical rather than straight as extruded.

The ability to backtwist can be provided as part of the commercial twinning machine, and when provided, the backtwist can be used when the wire is off center within the cylindrical polymer insulation, to improve (reduce) impedance instabilities caused by insulation diameter variation and less than perfect insulation concentricity within the cylindrical insulation. The backtwist is designed to cause the nesting relationship between the twisted pair of insulated wires, i.e. to have the helical shape of the peaks and valleys to resemble the helix formed by the twinning step The backtwist, carried out just prior to twining, is accompanied by some lessening (relaxing) of the backtwist. This lessening (relaxation) results in the alignment and thus interlocking of helical peak and valley of the neighboring polymer-insulated conductors brought into contact with one another by the twinning step. This nesting continues along the length of the twisted pair as the twinning step is carried out.

It is disclosed in US 2008/0296042 that is it desirable for the peaks (crests) of a profile insulation of each of the polymer-insulated conductors of a twisted pair to increase the distance between conductors of the twisted pair, i.e. to avoid nesting. This is accomplished by a twinning process that provides peak-to-peak contact between the profile-insulated conductors of a twisted pair, such as shown in FIG. 7C of U.S. Pat. No. 5,990,419. Such twinning process would involve no backtwisting, backtwisting of each of the profile-insulated conductors in opposite directions (one direction being the direction of the twinning), or backtwisting in the same direction and in the opposite direction of the twinning but an insufficient amount. Since the extruded profile runs along the length of the polymer-insulated conductor, and twinning involves crossing these insulated wires over one another, peak to peak contact between the insulated wires in the twisted pair is inevitable.

Surprising as will be presented in Example 4, the nesting accomplished by the process of the present invention provides a superior impedance result than when the profile-insulated conductor contact is peak-to-peak in the twisted pair. This is surprising because the nesting relationship provides closer spacing between the conductors of the twisted pair than the peak-to-peak relationship.

The polymer insulation on the conductors is unfoamed or foamed. The improvement of the present invention further comprising applying a jacket to encase at least two twisted pairs, thereby forming a cable.

Pursuant to another aspect of the present invention, there is provided a pair of conductors each having polymer insulation thereon, the polymer insulation on each of said conductors having an exterior surface comprising: peaks and valleys alternating longitudinally along said exterior surface, said pair of conductors each having said polymer insulation thereon being twisted together to form a twisted pair wherein at least one of said peaks in the exterior surface of said polymer insulation on one of said conductors is nested in one of said valleys in the exterior surface of said polymer insulation on the other of said conductors to provide an improved impedance efficiency as compared to polymer insulation of the same weight but of uniform thickness, i.e. greater impedance per lb/1000 ft of polymer insulation. Thus, less weight of polymer insulation can be used to achieve the same impedance as with conventional polymer insulation (uniform thickness). The polymer insulation on the conductors is unfoamed or foamed.

The pair of conductors further comprising a polymer jacket being applied to encase at least two of said twisted pairs of polymer insulated conductors to form a cable. Pursuant to another aspect of the present invention, there is provided a coaxial cable, comprising a central conductor, polymer insulation encasing said central conductor, and an outer conductor encasing said polymer insulation, said polymer insulation having an exterior surface comprising longitudinally running peaks and valleys, said outer conductor bridging said valleys. The polymer insulation can be unfoamed or foamed.

BRIEF DESCRIPTION OF THE DRAWINGS

The invention will be more fully understood from the following detailed description, taken in connection with the accompanying drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings for a detailed description of the present invention. In the process of twisting the polymer-insulated conductors of the present invention together (e.g. twinning), the insulation compresses as a result of torsional forces from tensioning and actual drag through the twinning machine. The shorter the twist, the more compression occurs. Traditionally, the insulation compression is counteracted by adding more insulation in order that the final center to center spacing of the conductors for a desired twist length is achieved.

In the present invention, a preferred embodiment for the insulation shape around the conductor produced from an extrusion process is a series of arches (e.g. scalloped) around the outer circumference of the insulation. This process 1) reduces the tension through the twinning machine by decreasing the contact surface area of the insulation with the machine components; 2) increases the crush resistance of the insulation layer; 3) increases the conductor center to center distance in the twisted pair with less total insulation weight than conventional round insulation; and 4) increases the insulation to insulation surface contact area.

Figure 1:
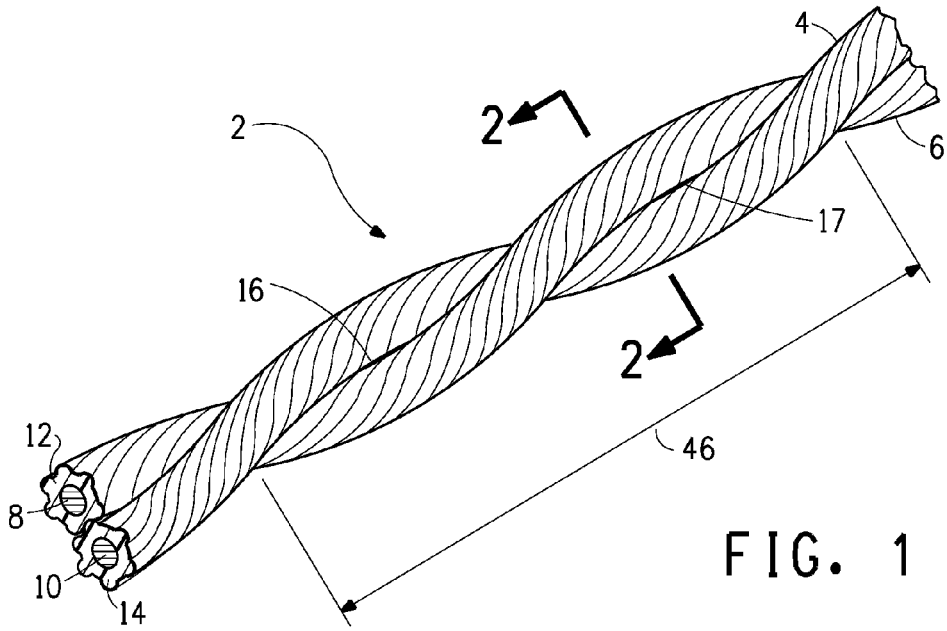
FIG. 1 is an enlarged isometric view of a back twisted pair of polymer-insulated conductors of the present invention, showing the constitution of the radially outward polymer insulation with helically wound peaks and valleys.
Figure 3:
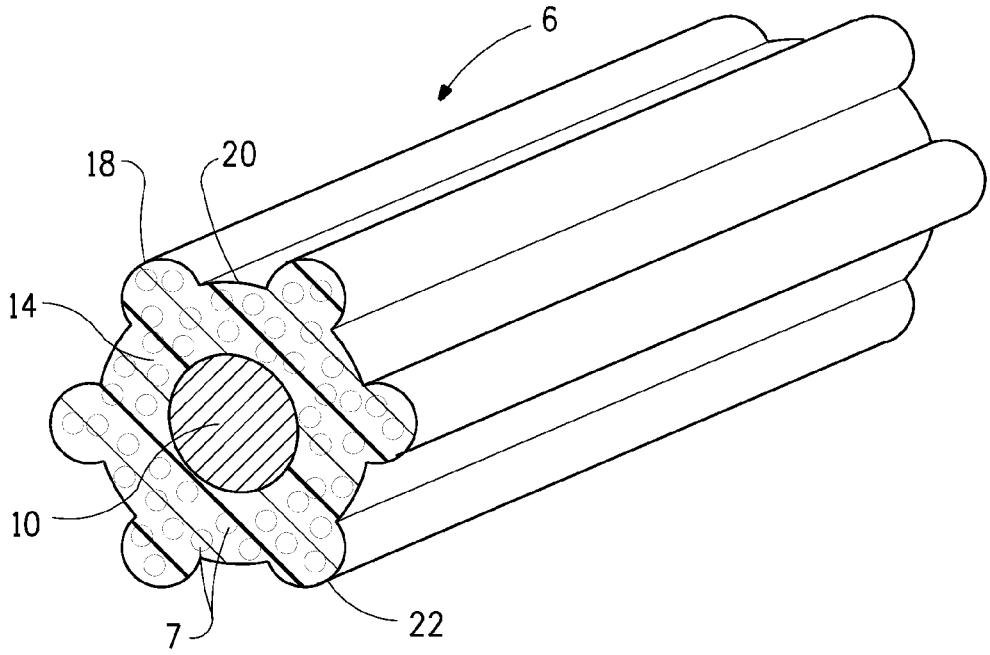
FIG. 3 is an enlarged perspective view of an embodiment of an indeterminate length of an as extruded foamed polymer-insulated conductor of the present invention.

FIG. 1 shows a twisted pair 2 of polymer insulated conductors 4 and 6, each consisting of a central conductor 8 and 10, respectively, such as of copper, and polymer insulation 12 and 14, respectively. The twinning process to form the twisted pair 2 is a conventional operation with the exception of the effective same direction backtwisting opposite to the twist direction of the twinning described hereinbefore, causing the corrugated or shaped exposed exterior surfaces of insulation 12 and 14 to be forced together such as at contact points 16 and 17. The surface of the polymer insulation of the present invention contains peaks and valleys forming a corrugated exterior surface. The polymer insulation can be foamed or unfoamed. The voids providing the foamed aspect of the polymer insulation 12, 14 are approximately spherical in shape and are shown in FIG. 3 as small circles 7 within the polymer insulation. Another embodiment would be to extrude or mold a solid skin on the foamed polymer insulation. The solid skin typically has a thickness of about 1-2 mils.

Figure 2:
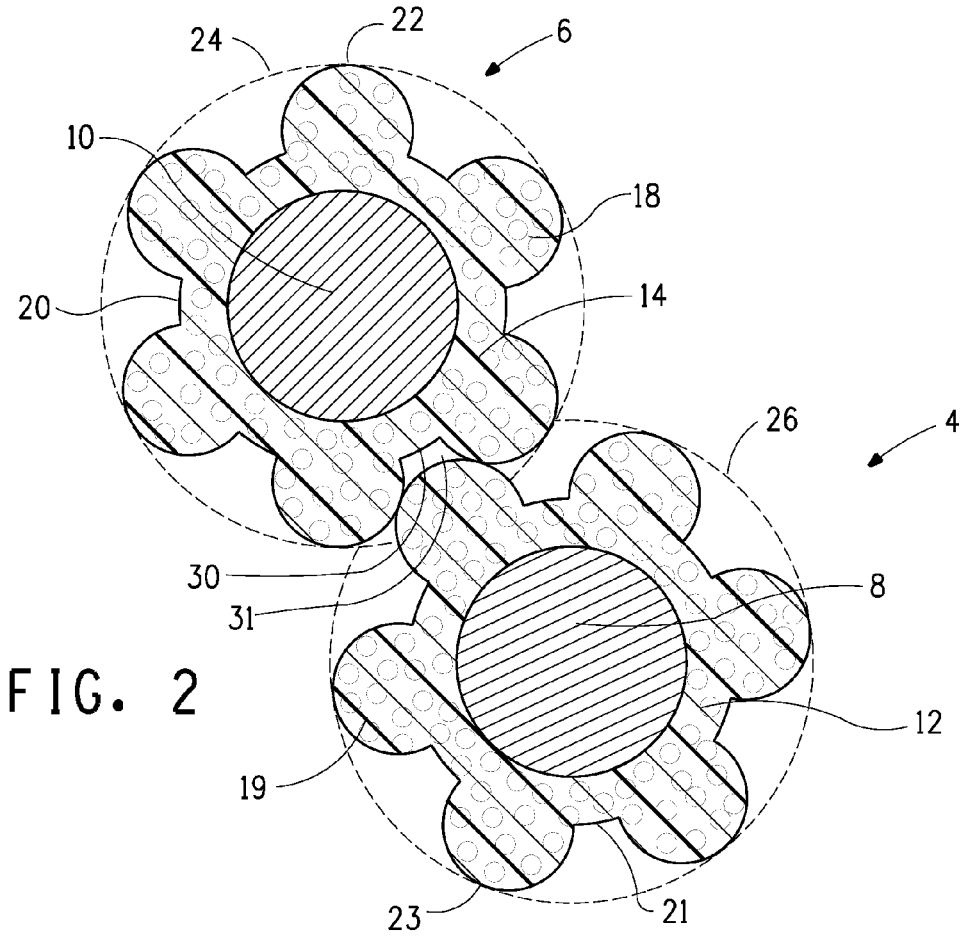
FIG. 2 is an enlarged cross-sectional view of the twisted pair of the present invention of FIG. 1 along section 2-2, showing a foamed polymer insulation embodiment.

FIG. 2 shows a cross-sectional view of the twisted pair of FIG. 1 along section 2-2. FIG. 2 shows a foamed polymer insulated conductor embodiment. The foamed polymer insulation 12, 14 encasing conductor 8, 10 has multiple peaks 18, 19 and valleys 20, 21. The tops of the peaks 22, 23 are rounded in this embodiment for a scalloped type of peak profile. This embodiment shows an outer diameter (circumference) represented by phantom line 24, 26. The inner diameter of the polymer insulation is defined by the circle whose circumference coincides with the bottom (i.e. depth) of the valleys 20, 21. When the peaks 18, 19 are subjected to a crushing force, they tend to reduce the outer diameter 24, 26 of the foamed polymer insulation 12, 14 towards an intermediate diameter between the inner and outer polymer insulation diameter. In contrast, when the polymer insulation is of uniform thickness and has an intermediate diameter as the outer diameter the same crushing force tends to reduce the intermediate diameter towards the inner diameter, thereby reducing the effective thickness of the insulation as compared to when the peaks and valleys are present. A solid polymer insulation for the present invention responds similarly to that described above with regard to foamed insulation, however, the compression affect on the solid or unfoamed polymer from the crushing force is less than that on a foamed polymer insulation.

With continued reference to FIG. 2, the inner diameter of the polymer insulation of the present invention is less than the diameter of the polymer insulation obtained by extruding the same weight of the polymer but in uniform thickness (conventional insulation) onto the conductors. The thickness 24, 26 of the polymer insulation of the present invention is 4-100 mils and even up to 125 mils (3.1 mm), preferably 4-20 mils (0.1-0.5 mm), more preferably 6-14 mils (0.15-0.36 mm). The thickness of the insulation of the present invention on coaxial cable is typically 4-100 mils (0.1-2.5 mm) and even up to 125 mils (3.1 mm). Each of the polymer insulated conductors of the present invention is formed by extruding polymer onto the conductors. The polymer is extruded forming longitudinally running peaks and valleys on the exterior surface of each of the insulated conductors as shown in FIG. 3. The resultant polymer-insulated conductors are twisted to nest at least one of the peaks 30 of the exterior surface of one of the polymer insulated conductors in a valley 31 of the exterior surface of the other polymer-insulated conductor of the twisted pair as shown in FIG. 2. This twinning of polymer insulated conductors to nest in the valley of the other polymer insulated conductor provides the improved impedance efficiency by using a lesser amount of polymer by weight (lbs/1000 feet is the customary unit) than used in a typical non-corrugated insulation. The polymer insulated conductors of the present invention are separate from one another prior to twinning a pair of conductors. An embodiment of the present invention of the pair of conductors with polymer insulation is shown in FIG. 2 as a cross-sectional shape of peaks that form 25 a scalloped edge profile.

The cross-sectional shape of FIG. 2 shows the nesting embodiment between the twisted polymer insulated conductors 4, 6 of FIG. 1. The twinning process of the present invention is such that the peaks have a smaller or lesser width than the valleys or, alternatively, the peaks have a greater width than the valleys. This is such that the nesting peak 30 of the one polymer-insulated conductor of a twisted pairs does not fill up the valley 31 of the other polymer-insulated conductors of the twisted pairs. The peaks and valleys could also be of equal width in the present invention for nesting. Two or more twisted pairs can be enclosed or encased in a polymer jacket to form a twisted pair cable.

In FIG. 3, a perspective view of an embodiment of indeterminate length is shown. The polymer insulated conductor 6 comprises a conductor 10 and polymer insulation 14 encasing the conductor 10. The conductor 10 is centered within the polymer insulation 14. The exterior surface of the polymer insulation 14 is composed of peaks 18 and valleys 20 running along the length of the polymer insulated conductor 6. The peaks 18 and valleys 20 alternate with one another, i.e. the valleys separate adjacent peaks from one to another. The number of peaks and intervening valleys, and the width of the peaks (measured at their base) and of the valleys (measured from the outer base edge of one peak to the adjacent peak outer base edge) vary according to the communications or other wire and cabling applications intended for the polymer-insulated conductor 6.

In the processes and product of the present invention, the peaks and valleys are continuous along the entire length of the insulation and are parallel to the conductor as extruded as shown in FIG. 3. The polymer-insulated conductors are twinned to form a twisted pair. In the course of twinning, the individual polymer-insulated conductors are first backtwisted by the twinning machine, followed by the insulated conductors being twisted together. The effect of the backtwisting changes the disposition of the peaks and valleys on the insulation exterior surface, from parallel to helical. Typically, the backtwisting needed to obtain nesting will be from about 25% to 35% to provide the effect wherein the profiles of the individual insulated conductors will nest during the twinning step. This backtwist is determined by the relative rates of the backtwisting and twinning steps. For example, at a twinning rate of 2000 twists per min to produce a long lay (0.5 in, 1.27 cm) in the twisted pair, the backtwist would be carried out at a rate of 600 twists per min to produce the backtwist of 30%. The twinning is carried out with the helical longitudinally running peaks and valleys of the two polymer-insulated conductors being disposed in the same direction as shown in FIG. 1. The twinning of the longitudinally running helical peaks and valleys thus results in a peak from one insulation nesting within a valley of the other insulation of the twisted pair.

One aspect of the present invention is that the polymer insulation has a corrugated surface created by the longitudinally running peaks and valleys. The number of peaks present depends on the diameter of the polymer insulation. As the diameter increases, so does the circumference, which means that the peak width chosen for a small diameter polymer insulation, if used on a larger diameter polymer insulation, will require more peaks. Alternatively, the peak widths could be increased. The peaks are not tall and thin, because such configuration does not improve crush resistance. Such peaks tend to fold over upon themselves upon being subjected to crushing. The peaks used in the present invention have sufficient width relative to height that they do not fold during crushing. Preferred quantitative characterizations of the peaks are independently as follows: (i) the height of the peaks is no greater than about 150% of the width of said peaks, (ii) the peaks cover at least about 30% of the exterior surface (valley circumference) of the polymer insulation (this defines the foot print of the peaks), and (iii) the peaks have a height that is at least about 50% of the width of the peaks. As the width of the peaks decrease the number of peaks increased to provide equivalent improvement. For the very small size (diameter) communications cable, such as wherein the overall thickness of insulation is about 6 to 14 mils (0.150 to 0.360 mm), and the height of the peaks is at least about 25% of said overall thickness. For these insulation thicknesses, the surface profile preferably comprises at least 8 peaks, preferably at least 10, each peak having an intervening valley. Overall thickness is the thickness of the insulation from the conductor surface to the top of the peaks. The width of the peaks is the distance across the base of the peaks where they intersect with the valleys. The height of the peaks is measured from the circumference defined by the valleys (valley circumference) to the top of the peaks. Preferably the peaks are rounded to facilitate nesting. Generally, a jacket is applied over either the twisted pair or coaxial constructions to complete the communications cable. Multiple twisted pairs can be bundled together in a single jacket.

For the twisted pair insulation thicknesses, the height of the peaks, as disclosed above, is preferably at least 25% of the thickness of the overall polymer insulation, more preferably at least 30%, and even more preferably, at least 40 % thereof. Generally, folding of the peaks during crushing is avoided if the height of the peaks is no more than 150% of the width of the peaks, preferably no more than 125%, and more preferably no more than 100% thereof. Of course, the peaks are also wide enough that they do not fold upon crushing, which is generally obtained when the width of the peaks range from 75% or 100% of the peak height to 200% of the peak height. Another indication of the peak width is the coverage of the peaks on the circumference of the polymer insulated cable, the circumference in this case meaning the inner diameter of the foamed polymer insulation represented by the surface (floor) of the valleys. Preferably, the peaks cover up to about 90% of the circumference (valley surface), preferably at least 35% of such circumference.

The peaks are prominent in the surface of the insulation, e.g. for the 4 to 20 mil (0.1 to 0.5 mm) and 6 to 14 mil (0.15 to 0.35 mm) overall thickness ranges for the insulation, the peak height preferably ranges from 3 to 7 mils (0.075 to 0.175 mm), preferably 4 to 6 or 7 mils (0.1 to 0.15 or 0.175 mm). For thicker insulation (overall thickness) from 20 to 125 mils (0.5 to 3.1 mm), the peak height will preferably be from 3 to 20 mils (0.076 to 0.5 mm). For all these peak heights, the peak width will preferably be in the range of 75 to 200% of the peak height.

The present invention extrusion, backtwisting, and twinning described above maintains the desired impedance performance for the twisted pair while maintaining or reducing the amount of polymer used in insulating the conductors (i.e. impedance efficiency). The polymer material for the insulation can be foamed or unfoamed. For purposes of this specification the term unfoamed means solid or that under a magnification of 40×, virtually no voids are visible in the regions at the interior and exterior surfaces of the foamed polymer.

Figure 4:
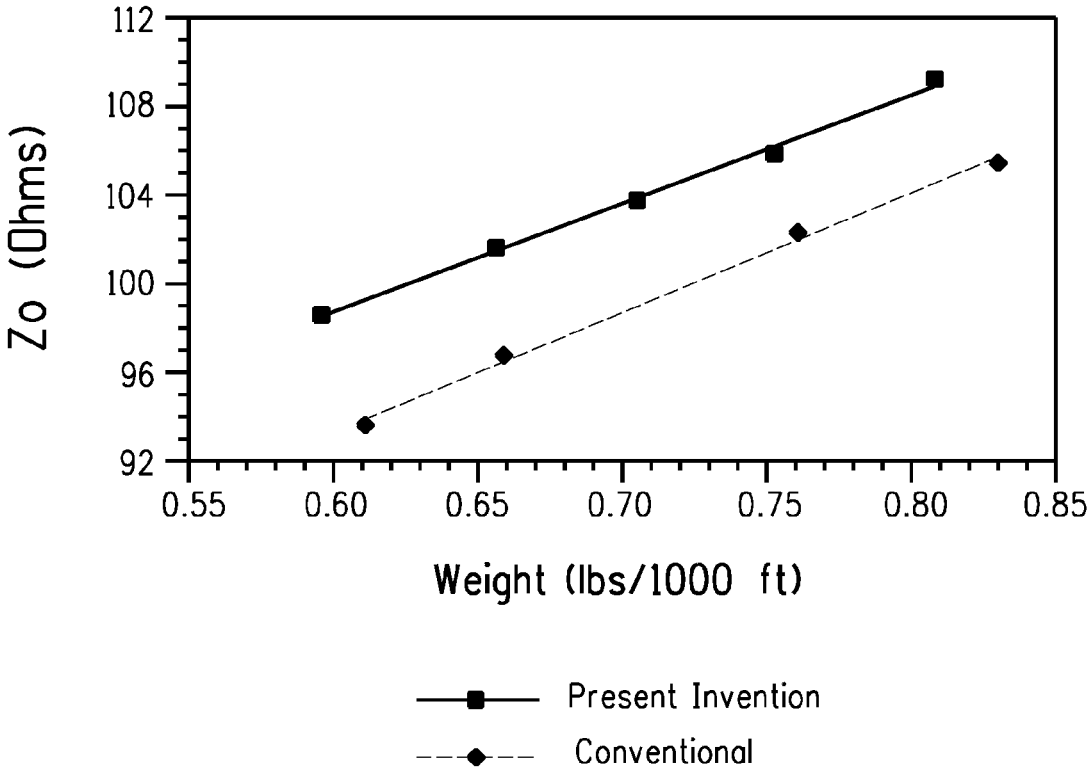
FIG. 4 is a graphical illustration of the difference in insulation weight between the present invention and conventional insulated conductors with a 0.5 inch twist length (lay) at the same impedance.

The desired impedance performance for a twisted pair is 100 ohms. FIG. 4 shows a graphical illustration of impedance ($Z_o$) as a function of the amount of insulation (lbs/1000 ft) on the insulated conductor of the present invention compared to conventional insulation for solid insulation twisted pair with a 0.5 inch twist length (i.e. lay). At an impedance of 100 ohms, the present invention has a polymer weight of about 0.625 lbs/1000 ft in contrast to the conventional weight of about 0.730 lbs/1000 ft. The present invention is shown by a solid line and the conventional is shown by a dashed line in FIG. 4. This shows that less polymer weight is required to maintain 100 ohms impedance in the present invention than in the conventional case. The present invention graphically represented in FIG. 4 is for an unfoamed or solid twisted pair and the conventional representation is for a solid twisted pair.

Any method for foaming the polymer to form the foamed regions of the polymer insulation of the present invention can be used. It is preferred, however, that the method used will obtain cells (voids) that are both small and uniform for the best combination of electrical properties, such as low return loss and high signal transmission velocity. In this regard, the cells are preferably about 50 micrometers in diameter or less and the average void content is about 10 to 70%, preferably about 20 to 50%, more preferably about 20 to 35%. Average void content is determined by capacitance measurement on the insulated conductor. It is preferable for twisted pair that the average void content is between 0-35% and more preferably 10-35%. For coaxial cable, the average void content is preferably 10-70%. Average void content is determined by comparing the weight of the foamed insulation with the weight of unfoamed insulation (same polymer) of the same dimensions according to the following equation;

$$\text{Void content (vol \%)} = 100(1 - [\text{foamed wt/unfoamed wt}]).$$

Figure 6:
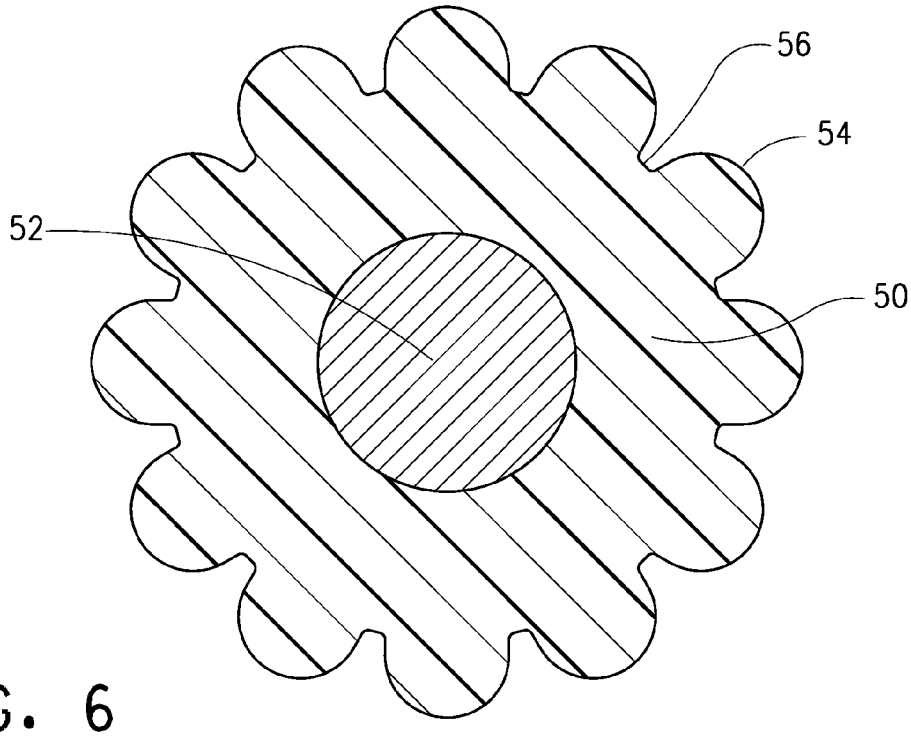
FIG. 6 shows a cross-sectional view of an embodiment of a solid (i.e. unfoamed) polymer insulation of the present invention.
Figure 7:
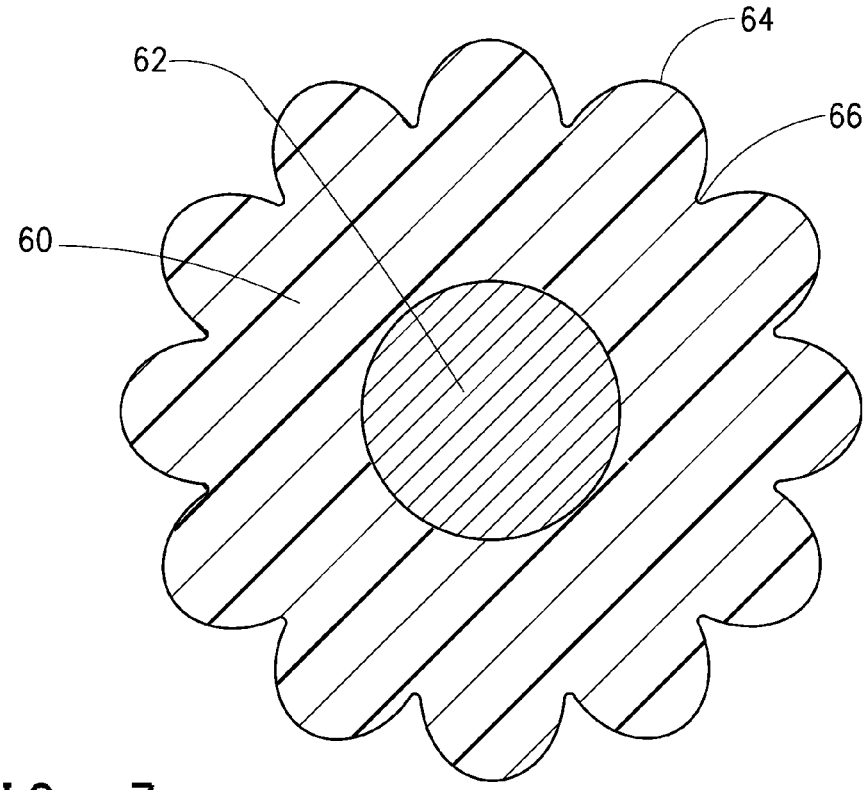
FIG. 7 shows a cross-sectional view of another embodiment of a solid (i.e. unfoamed) polymer insulation of the present invention.

FIGS. 6 and 7 show embodiments of two unfoamed polymer insulated conductors of the present invention with twelve (12) peaks. In FIG. 6, the unfoamed polymer insulation 50 encasing the conductor 52 has longitudinally running peaks 54 and valleys 56. As in FIG. 2, the peaks 54 are rounded at their tops. In FIG. 7, the unfoamed polymer insulation 60 encasing the conductor 62 has the same number of longitudinally running peaks 64 and valleys 66 as in FIG. 6, but the peaks 64 are wide enough that the valleys 66 have little to no width. In this embodiment, the valleys 66 are simply the location of the intersection (interconnection) of adjacent peaks 64. The tops of peaks 64 are rounded.

Figure 8:
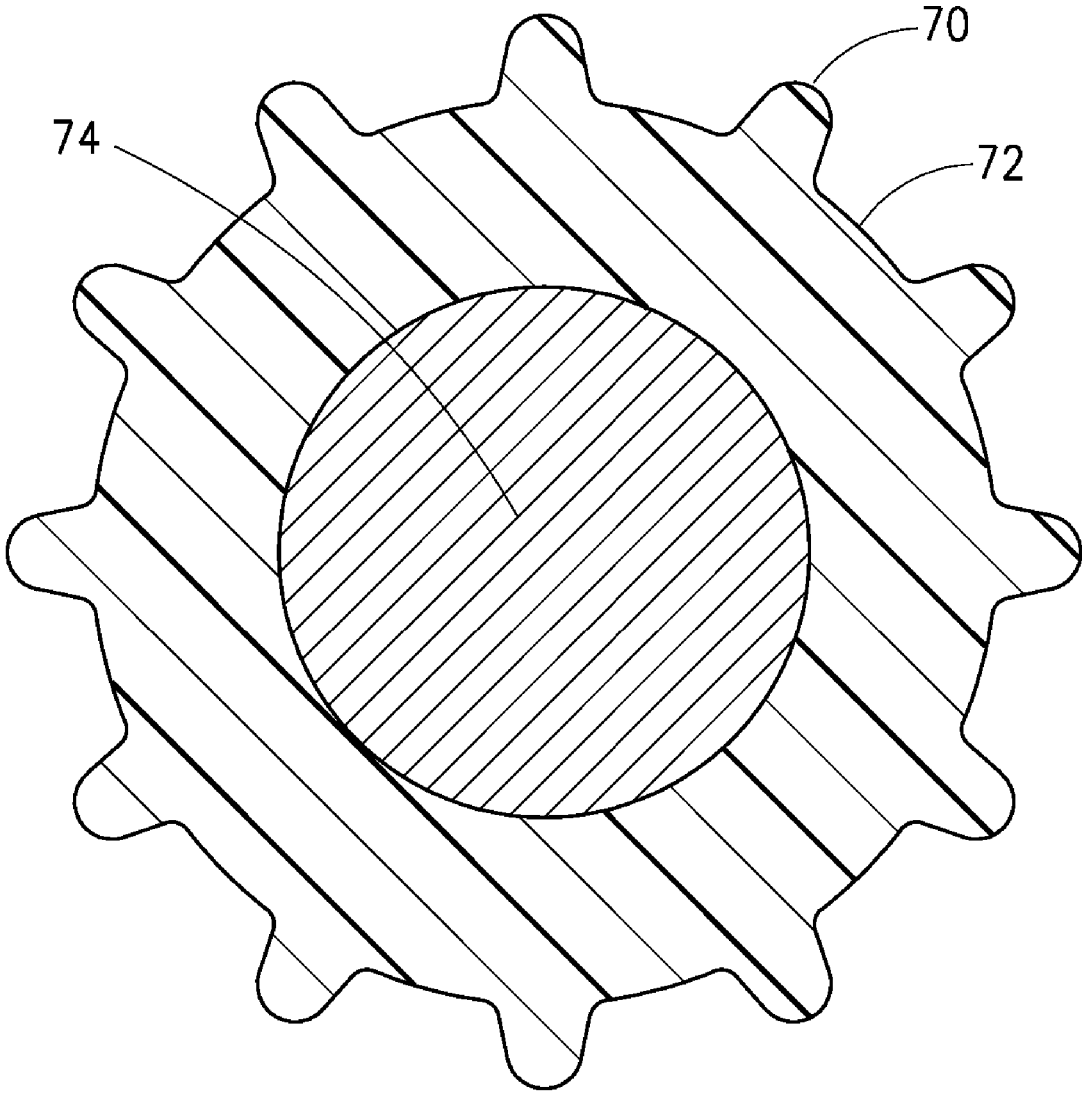
FIG. 8 shows a cross-sectional view of still another embodiment of solid polymer insulation of the present invention and used in Examples 2 and 4.

A preferred embodiment (not shown) is the configuration shown in FIG. 6, but with narrower peaks such as shown In FIG. 8, whereby the nesting peak can contact the "floor" of the valley on the adjacent insulated conductor, without filling up the valley, whereby air is entrapped between adjacent insulated conductors.

The polymer insulation for the present invention can be any thermoplastic polymer that can be used to coat a conductor (preferably by extrusion) that has the electrical, physical, and thermal properties desired for the particular communications or other cabling application. The most common such polymer insulations are polyolefin and fluoropolymer. Non-fluorinated polymer other than polyolefin can also be used.

The fluoropolymer used in the present invention is preferably a copolymer of tetrafluoroethylene (TFE) and hexafluoropropylene (HFP). In these copolymers, the HFP content is typically about 6-17 wt %, preferably 9-17 wt % (calculated from HFPI×3.2). HFPI (HFP Index) is the ratio of infrared radiation (IR) absorbances at specified IR wavelengths as disclosed in U.S. Statutory Invention Registration H130. Preferably, the TFE/HFP copolymer includes a small amount of additional comonomer to improve properties. The preferred TFE/HFP copolymer is TFE/HFP/perfluoro(alkyl vinyl ether) (PAVE), wherein the alkyl group contains 1 to 4 carbon atoms. Preferred PAVE monomers are perfluoro(ethyl vinyl ether) (PEVE) and perfluoro(propyl vinyl ether) (PPVE). Preferred TFE/HFP copolymers containing the additional comonomer have an HFP content of about 6-17 wt %, preferably 9-17 wt % and PAVE content, preferably PEVE, of about 0.2 to 3 wt %, with the remainder of the copolymer being TFE to total 100 wt % of the copolymer. Examples of FEP compositions are those disclosed in U.S. Pat. No. 4,029,868 (Carlson), U.S. Pat. No. 5,677,404 (Blair), and U.S. Pat. No. 6,541,588 (Kaulbach et al.) and in U.S. Statutory Invention Registration H130. The FEP is partially crystalline, that is, it is not an elastomer. By partially crystalline is meant that the polymers have some crystallinity and are characterized by a detectable melting point measured according to ASTM D 3418, and a melting endotherm of at least about 3 J/g.

Other fluoropolymers, which are not elastomers, can be used, i.e. polymers containing at least 35 wt % fluorine, that are melt fabricable so as to be melt extrudable, but FEP is preferred because of its high speed extrudability and relatively low cost. In particular applications, ethylene/tetrafluoroethylene (ETFE) polymers will be suitable, but perfluoropolymers are preferred, these including copolymers of tetrafluoroethylene (TFE) and perfluoro(alkyl vinyl ether) (PAVE), commonly known as PFA, and in certain cases MFA. PAVE monomers include perfluoro(ethyl vinyl ether) (PEVE), perfluoro(methyl vinyl ether) (PMVE), and perfluoro(propyl vinyl ether) (PPVE). TFE/PEVE and TFE/PPVE are preferred PFAs. MFA is TFE/PPVE/PMVE copolymer. However, as stated above, FEP is the most preferred polymer, and this is the polymer used as the insulation in the Examples.

The fluoropolymers used in the present invention are also melt-fabricable, i.e. the polymer is sufficiently flowable in the molten state that it can be fabricated by melt processing such as extrusion, to produce wire insulation having sufficient strength so as to be useful. The melt flow rate (MFR) of the perfluoropolymers used in the present invention is preferably in the range of about 5 g/10 min to about 50 g/10 min, preferably at least 20 g/10 min, and more preferably at least 25 g/10 min.

MFR is typically controlled by varying initiator feed during polymerization as disclosed in U.S. Pat. No. 7,122,609 (Chapman). The higher the initiator concentration in the polymerization medium for given polymerization conditions and copolymer composition, the lower the molecular weight, and the higher the MFR. MFR may also be controlled by use of chain transfer agents (CTA). MFR is measured according to ASTM D-1238 using a 5 kg weight on the molten polymer and at the melt temperature of 372° C. as set forth in ASTM D 2116-91a (for FEP), ASTM D 3307-93 (PFA), and ASTM D 3159-91a (for ETFE, which is measured at 297° C.).

Fluoropolymers made by aqueous polymerization, as polymerized contain at least about 400 end groups per $10^6$ carbon atoms. Most of these end groups are unstable in the sense that when exposed to heat, such as encountered during extrusion, they undergo chemical reaction such as decomposition, either discoloring the extruded polymer or filling it with non-uniform bubbles or both. Examples of these unstable end groups include —COF, —$CONH_2$, —COOH, —CF=$CF_2$ and/or —$CH_2OH$ and are determined by such polymerization aspects as choice of polymerization medium, initiator, chain transfer agent, if any, buffer if any. Preferably, fluoropolymers are stabilized to replace substantially all of the unstable end groups by stable end groups. The preferred methods of stabilization are exposure of the perfluoropolymer to steam or fluorine at high temperature. Exposure of the perfluoropolymer to steam is disclosed in U.S. Pat. No. 3,085,083 (Schreyer). Exposure of the perfluoropolymer to fluorine is disclosed in U.S. Pat. No. 4,742,122 (Buckmaster et al.) and U.S. Pat. No. 4,743,658 (Imbalzano et al.). These processes can be used in the present invention. The analysis of end groups is described in these patents. The presence of the —CF3 stable end group (the product of fluorination) is deduced from the absence of unstable end groups existing after the fluorine treatment, and this is the preferred stable end group, providing reduced dissipation factor as compared to the —$CF_2H$ end group stabilized perfluoropolymer the product of steam treatment. Preferably, the total number of unstable end groups constitute no more than about 80 such end groups per $10^6$ carbon atoms, preferably no more than about 40 such end groups per $10^6$ carbon atoms, and most preferably, no greater than about 20 such end groups per $10^6$ carbon atoms.

Examples of non-fluorinated thermoplastic polymers include polyolefins, polyamides, polyesters, and polyaryleneetherketones, such as polyetherketone (PEK), polyetheretherketone (PEEK), and polyetherketoneketone (PEKK). Polyolefins may also be used as insulation according to the present invention. Examples of polyolefins include polypropylene, e.g. isotactic polypropylene, linear polyethylenes such as high density polyethylenes (HDPE), linear low density polyethylenes (LLDPE), e.g. having a specific gravity of 0.89 to 0.92. The linear low density polyethylenes made by the INSITE® catalyst technology of Dow Chemical Company and the EXACT® polyethylenes available from Exxon Chemical Company can be used in the present invention; these resins are generically called (mLLDPE). These linear low density polyethylenes are copolymers of ethylene with small proportions of higher alpha monoolefins, e.g. containing 4 to 8 carbon atoms, typically butene or octene. Any of these thermoplastic polymers can be a single polymer or a blend of polymers. Thus, the EXACT® polyethylenes are often a blend of polyethylenes of different molecular weights. The polymer forming the insulation can also contain other additives that are commonly used in polymer insulation, such as pigments, extrusion aids, fillers, flame retardants, and antioxidants, depending on the identity of the polymer being used and properties to be enhanced.

Figure 5A:
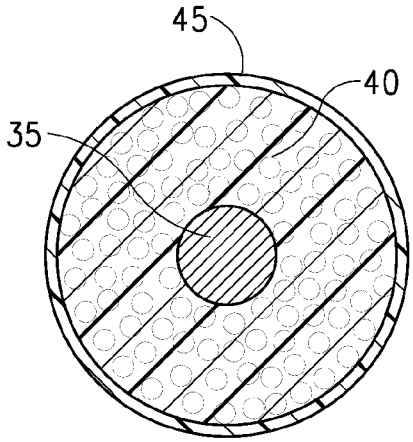
FIG. 5A shows a cross-sectional view of a conventional foamed polymer-insulated coaxial cable.
Figure 5B:
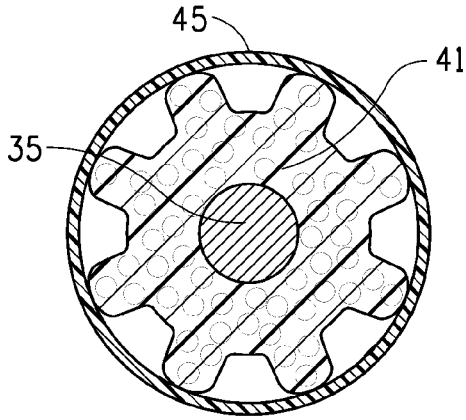
FIG. 5B shows a cross-sectional view of a foamed polymer-insulated coaxial cable of the present invention, wherein the insulation has a scalloped profile.

The conductor used in the present invention is any material that is useful for transmitting signals as required for service in a communications cable. Such material can be in the form of a single strand or can be multiple strands twisted together or otherwise united to form a unitary strand. The most common such material is copper or copper containing. For example, a copper conductor may be plated with a different metal such as silver, tin or nickel. The present invention is not only applicable to twisted pair applications as discussed above but also for coaxial cable. A coaxial cable is a cable consisting of inner 35 and outer 45 conductors with an insulating layer 40, 41 there between as shown in FIGS. 5A and 5B. The outer conductor 45 has a braid of conductive material such as copper wire strands and/or a metalized tape. These coaxial cables are produced to a set impedance of normally 50 to 75 ohms. The impedance is a function of the spacing between the inner 35 and outer 45 conductors and the dielectric constant of the insulating material 40, 41. (The insulating material though shown as foamed in FIGS. 5A, 5B can also be unfoamed.) By reducing the dielectric constant, the cable insulation can be made thinner or, a larger inner conductor can be used to reduce attenuation while still maintaining the same impedance.

EXAMPLES

The conductor used in the Examples unless otherwise indicated is copper single strand wire having a diameter of 22.6 mils (565 μm). The polymer insulation of Examples 1 and 3 has a void content of 20 vol % unless otherwise specified. The unfoamed layer at the inner surface of the insulation is observable by viewing a cross section of the polymer-insulated conductor under magnification. Example 2 is for unfoamed polymer insulation. The unfoamed exterior surface of the insulation is observable by the surface of the insulation being void free in appearance. Both the foamed and unfoamed polymer insulation encasing the conductors are formed by extruding.

Example 1

In an embodiment of the present invention, the profile of a scalloped insulation surface is used for a foamed insulation coaxial cable as shown in FIG. 5B. In Table 1 below, the properties of a typical or conventional foamed coaxial cable (FIG. 5A) are compared to the scalloped foamed insulation coaxial cable (FIG. 5B) of the present invention. As indicated in Table 1 the significant difference is the insulation weight. Capacitance, VP (velocity of propagation) and calculated impedance are virtually the same. The weight of the conventional foamed insulation is about 0.918 lb/1000 ft versus the reduced weight of 0.721 lb/1000 ft. This weight reduction in material while maintaining the electrical and mechanical properties of the coaxial cable provides a significant cost savings to the manufacturer.

Table 1 shows the electrical properties of the conventional foamed coaxial cable (FIG. 5A) in comparison to the present invention of the scalloped foamed coaxial cable (FIG. 5B).

TABLE 1

| Properties | Conventional Foamed Conventional Coaxial Cable | Scalloped Foamed Coaxial Cable of the Invention |
|---|---|---|
| Capacitance (picofarads/ft) | 17 | 17 |
| VP (%) | 84 | 84 |
| Insulation Weight (lbs/1000 ft) | 0.918 | 0.721 |
| Insulation Diameter (inches) | 0.074 | 0.074 |

In Table 1, the calculated impedance for the conventional coaxial cable and scalloped foamed coaxial cable are virtually the same. The calculated impedance was determined using the following formula:

$$Z_o = \frac{101670}{\text{Capacitance} \times VP}$$

where:

$Z_o$=Impedance (Ohms)

Capacitance=picofarads/ft

VP=% of the speed of light

Example 2

This Example compares the impedance for twisted pairs of insulated wires when (i) the insulation for the twisted pair is a profile insulation of the present invention (Invention in Table 2) and (ii) the insulation for the twisted pairs is non-profile insulation, i.e. resembling a cylinder around the wire (Conventional in Table 2), wherein the weight of the insulation for all of the twisted pairs is kept constant at 0.832 lb/1000 ft. The impedance results are shown in Table 2 for various twinning rates (twists/min) and lays. The lay for the twisted pair is defined as the inches per complete twist, such as is shown by the bracket 46 in FIG. 1 The conventional insulation has a thickness of 9 mils. The Invention insulation has the cross-sectional configuration shown in FIG. 8. Details of this configuration are given in Example 4. The nesting of the insulated conductors forming the twisted pair of the Invention in Table 2 is obtained by backtwisting 30% each insulated conductor in the same direction opposite to the twinning direction and relaxation of the backtwist just prior to twinning to form the twisted pair.

Table 2 shows the higher impedance for the twisted pairs made according to the present invention over the twisted pairs made using non-profiled insulation over a wide range of twisting rates and lays. The fact that the twisted pairs made according to the present invention exhibit the higher impedance means that less polymer for the insulation of the wires is necessary to obtain the same impedance as the conventional (non-profiled) insulation. Thus, the present invention provides improved economy by virtue of enabling the amount of polymer needed for insulating the wires of the twisted pair to be reduced. This advantage arises from the greater crush resistance of the nested insulated wires of the twisted pair than the twisted pair resulting from using the conventional non-profile polymer insulation.

TABLE 2

Impedance Measurements on Twisted Pairs, Profile insulation vs Non-profile Insulation

| Lay Length (inches) | Twinning Rate (twists/min) | Invention Measured Impedance (ohms) | Conventional Measured Impedance (ohms) |
|---|---|---|---|
| 0.3 | 2000 | 101.8 | 98.9 |
| 0.3 | 4000 | 99.1 | 97.3 |
| 0.4 | 1586 | 109.3 | 104.0 |
| 0.4 | 3000 | 107.4 | 103.4 |
| 0.4 | 4414 | 105.0 | 101.5 |
| 0.5 | 2000 | 112.2 | 105.4 |
| 0.5 | 4000 | 109.5 | 104.9 |
| 0.54 | 3000 | 112.3 | 106.6 |

Example 3

The present invention also shows a reduction in polymer insulation required for foam designs when compared to the standard polymer insulation under similar conditions. The foamed polymer insulation of this Example resembles that of FIG. 2, wherein the 6 peaks are each 4 mils (0.1 mm) wide and 4 mils (0.1 mm) high and the overall insulation thickness is 11 mils (0.28 mm). The thickness of the insulation at the inner circumference defined by he valleys is 8 mils (0.2 mm). The diameter of the insulation from peak top to peak top is about 45 mils (1.143 mm). The peaks occupy about 41 % of the inner circumference of the polymer insulation defined by the valleys.

When this polymer-insulated conductor is twinned with another of the same polymer-insulated conductors at a twinning rate of 2000 turns/min to form a lay of 0.3 in (7.6 mm) for the twisted pair, a peak of one insulation nests in a valley of the other insulation assisted by the back-twisting of the individual polymer-insulated conductors prior to twinning. The impedance of the twisted pair is 100 ohms for both the conventional twisted pair of uniform thickness and the twisted pair of the present invention. In comparison, the foamed polymer insulation with the peaks and valleys weighed 0.706 lb/1000 ft, while the foamed polymer insulation (same void content) weighed 0.725 lb/1000 ft. Thus, the present invention maintained the same impedance using less material then the conventional twisted pair.

Example 4

This Example compares the impedance performance of twisted pairs wherein the profile insulation on each wire 74 (23 gauge, 0.0226 in dia.) is that of FIG. 8 having the following characteristics:

12 peaks and 12 intervening valleys (70 and 72, respectively in FIG. 8), an overall thickness of ~11.5 mils (0.29 mm) and thickness from the conductor to the valley of ~7.5 mils (0.19 mm), the peaks in cross-section tapering inwardly (narrowing) towards their tops, with the peak tops being rounded, the peaks occupying about 40% of the inner circumference of the profile, and the profile insulation weighing 0.832 lb/100 ft (~12 kg/km).

The twisted pair of profile insulation conductors are prepared in two ways, backtwisting of each insulated conductor in the same direction but opposite to the twist direction in the twinning step to obtain nesting, and backtwisting of each conductor in the opposite direction, wherein the contact between the profile insulation in the twisted pair is peak-to-peak. All backtwisting of is 30% and the backtwist is allowed to relax prior to twinning so that the peaks and valleys can alignment themselves at the time of twinning and interlock, peak to valley during twinning.

The impedance results are reported in Table 3 below.

TABLE 3

Impedance Measurement on Twisted Pairs

| Lay of twisted pair (cm) | Twinning Rate Twists/min | Nested Profile ohms | Peak-to-Peak Profile ohms |
|---|---|---|---|
| 1.27 | 2000 | 112.2 | 109.8 |
| 1.27 | 4000 | 109.5 | 107.9 |
| 1.02 | 3000 | 107.6 | 105.8 |
| 0.76 | 2000 | 101.8 | 100.5 |
| 0.76 | 4000 | 99.1 | 98.4 |

The greater impedance values obtained for the nested insulated conductors of the twisted pair as compared to the peak-to-peak insulated conductors of the twisted pair is a significant advantage revealed for the nesting relationship. This advantage persists over the common range of lays used in twisted pairs and over a wide range of twinning rates. The average statistical difference (95% confidence interval) evaluated over a range of twinning conditions (30% back-twisting and relaxation) consisting of ~1500 to 4500 twists per min and lay lengths ranging from ~0.66 cm to ~1.37 cm was 1.4 ohms. One conclusion to be drawn from this superiority is that the nesting relationship provides greater resistance to crushing of the insulation occurring in the twinning step than the peak-to-peak contact relationship.

It is therefore, apparent that there has been provided in accordance with the present invention, crush resistant conductor insulation that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

The invention claimed is:

1. A pair of conductors each having polymer insulation thereon, the polymer insulation on each of said conductors having an exterior surface comprising:

peaks and valleys alternating longitudinally along said exterior surface, said pair of conductors each having said polymer insulation thereon being twisted together to form a twisted pair wherein at least one of said peaks in the exterior surface of said polymer insulation on one of said conductors is nested in one of said valleys in the exterior surface of said polymer insulation on the other of said conductors to provide an improved impedance efficiency as compared to polymer insulation of the same weight but of uniform thickness.

2. The conductors according to claim 1, wherein the polymer for insulation is unfoamed.

3. The conductors according to claim 1, wherein the polymer for insulation is foamed.

4. The conductors according to claim 1, wherein said peaks have a lesser width than the valleys or said peaks have a greater width than the valleys, whereby the nesting peak does not fill up the nesting valley.

5. The conductors according to claim 1, further comprising a polymer jacket being applied to encase at least two of said twisted pairs of polymer insulated conductors to form a cable.

6. The conductors according to claim 1, wherein said polymer insulation has two diameters, an inner diameter measured at a depth of the valley and an outer diameter measured at a tip of the peak, the inner diameter being less than the diameter of the polymer insulation obtained by extruding the same weight of polymer but in uniform thickness onto the conductors.

7. The conductors of claim 5, wherein said cable is plenum cable.

8. The conductors of claim 6, wherein said peaks have a cross-sectional shape of a scalloped edge.

9. The conductors of claim 6, wherein said insulation thickness is 15 from 4 to 20 mils (0.1-0.5 mm).

10. The conductors of claim 1, wherein said polymer insulation has at least eight said peaks.

11. A coaxial cable, comprising a central conductor, polymer insulation encasing said central conductor, and an outer conductor encasing said polymer insulation, said polymer insulation having an exterior surface comprising longitudinally running peaks and valleys, said outer conductor bridging said valleys.

12. A cable according to claim 11, wherein said polymer insulation is unfoamed.

13. A cable according to claim 11, wherein said polymer insulation is foamed.

14. The conductors of claim 1, wherein the overall thickness of said polymer insulation is 6 to 14 mils and said polymer insulation has at least ten said peaks.

* * * * *